US007631366B2

(12) United States Patent
Oyama et al.

(10) Patent No.: US 7,631,366 B2
(45) Date of Patent: Dec. 15, 2009

(54) CROTCH-POSSESSING GARMENT

(75) Inventors: Makoto Oyama, Kyoto (JP); Yoshiaki Nakagawa, Kyoto (JP)

(73) Assignee: Wacoal Corp., Kyoto (JP)

( * ) Notice: Subject to any disclaimer, the term of this patent is extended or adjusted under 35 U.S.C. 154(b) by 12 days.

(21) Appl. No.: 10/554,797

(22) PCT Filed: Apr. 28, 2004

(86) PCT No.: PCT/JP2004/006184

§ 371 (c)(1),
(2), (4) Date: Dec. 16, 2005

(87) PCT Pub. No.: WO2004/096105

PCT Pub. Date: Nov. 11, 2004

(65) Prior Publication Data

US 2007/0067892 A1 Mar. 29, 2007

(30) Foreign Application Priority Data

May 1, 2003 (JP) ..... 2003-126492

(51) Int. Cl.
*A41D 1/00* (2006.01)
*A41D 13/00* (2006.01)

(52) U.S. Cl. ..... 2/228; 2/69

(58) Field of Classification Search ..... 2/69, 2/78.3, 400, 401, 404, 227, 231, 239–242, 2/228, 409; 450/100, 101, 115, 116, 122, 450/131, 132, 106, 117, 120, 123, 124, 125, 450/128, 130, 151; 606/203; 602/62; 482/121, 482/124

See application file for complete search history.

(56) References Cited

U.S. PATENT DOCUMENTS

| | | | | | |
|---|---|---|---|---|---|
| 2,586,614 | A | * | 2/1952 | Collini | 450/104 |
| 2,908,277 | A | * | 10/1959 | Peck | 450/101 |
| 2,958,327 | A | * | 11/1960 | Geissmann | 450/101 |
| 3,246,650 | A | * | 4/1966 | Wells | 450/104 |
| 3,261,359 | A | * | 7/1966 | Gould | 450/102 |
| 3,338,776 | A | * | 8/1967 | Blair | 428/88 |
| 3,512,532 | A | * | 5/1970 | Sutter | 450/98 |
| 3,542,033 | A | * | 11/1970 | Tenusiak | 450/104 |

(Continued)

FOREIGN PATENT DOCUMENTS

| | | |
|---|---|---|
| CN | 1298282 | 6/2001 |

(Continued)

*Primary Examiner*—Alissa L Hoey
(74) *Attorney, Agent, or Firm*—Darby & Darby, P.C.

(57) ABSTRACT

A long girdle includes a main body part for covering from a lumbar region to an upper part of a thigh, and a support line part stitched on the main body part. The support line part has a lower end beginning at a connecting line that connects front and rear portions of the main body part, and an upper end ending at the connecting line. The support line part extends over the front side of the thigh and a section which is located at the rear side of the thigh and the lower section of the rump-cleft, in a spiral to cover a region where the great adductor muscle of the thigh is located. The main body part and the support line part are configured with a stretchable material, and the tightening force of the support line part is stronger than that of the main body part.

8 Claims, 6 Drawing Sheets

U.S. PATENT DOCUMENTS

| | | | | | |
|---|---|---|---|---|---|
| 3,835,866 | A | * | 9/1974 | Brooks | 450/123 |
| 3,894,542 | A | * | 7/1975 | Sacristan | 450/123 |
| 4,216,547 | A | * | 8/1980 | Picchione | 2/22 |
| 4,390,999 | A | * | 7/1983 | Lawson et al. | 2/409 |
| 4,644,946 | A | * | 2/1987 | Cremona-Bonato | 602/61 |
| 4,862,523 | A | * | 9/1989 | Lipov | 2/409 |
| 5,060,639 | A | * | 10/1991 | Marcus | 602/19 |
| 5,201,074 | A | * | 4/1993 | Dicker | 2/70 |
| 5,263,923 | A | * | 11/1993 | Fujimoto | 602/62 |
| 5,267,928 | A | * | 12/1993 | Barile et al. | 482/124 |
| 5,367,708 | A | * | 11/1994 | Fujimoto | 2/22 |
| 5,447,462 | A | * | 9/1995 | Smith et al. | 450/122 |
| 5,613,893 | A | * | 3/1997 | Zagame | 450/155 |
| 5,819,322 | A | * | 10/1998 | Dicker et al. | 2/456 |
| 5,968,002 | A | * | 10/1999 | Morrisseau | 602/62 |
| 5,978,966 | A | * | 11/1999 | Dicker et al. | 2/69 |
| 6,047,405 | A | * | 4/2000 | Wilkinson | 2/69 |
| D427,750 | S | * | 7/2000 | Fujii et al. | D2/738 |
| 6,176,816 | B1 | * | 1/2001 | Dicker et al. | 482/124 |
| 6,186,970 | B1 | * | 2/2001 | Fujii et al. | 602/75 |
| 6,338,666 | B1 | * | 1/2002 | Ishii | 450/96 |
| 6,363,538 | B1 | * | 4/2002 | Davis | 2/247 |
| 6,430,752 | B1 | * | 8/2002 | Bay | 2/228 |
| 6,454,628 | B1 | * | 9/2002 | Shunichirou | 450/155 |
| 6,684,410 | B2 | * | 2/2004 | Robinett et al. | 2/228 |
| D496,522 | S | * | 9/2004 | Oya et al. | D2/702 |
| D505,769 | S | * | 6/2005 | Ota et al. | D2/731 |
| D517,279 | S | * | 3/2006 | Fujii | D2/731 |
| D520,715 | S | * | 5/2006 | Ota et al. | D2/731 |
| 7,087,032 | B1 | * | 8/2006 | Ikeda | 602/19 |
| 7,467,424 | B2 | * | 12/2008 | Sokoloff | 2/232 |
| 2003/0019014 | A1 | * | 1/2003 | Duran | 2/239 |
| 2003/0028952 | A1 | * | 2/2003 | Fujii et al. | 2/400 |
| 2003/0101506 | A1 | * | 6/2003 | Fujii et al. | 2/240 |
| 2004/0016043 | A1 | * | 1/2004 | Uno et al. | 2/400 |
| 2004/0107479 | A1 | * | 6/2004 | Dicker et al. | 2/227 |
| 2004/0111781 | A1 | * | 6/2004 | Miyake et al. | 2/69 |
| 2004/0255358 | A1 | * | 12/2004 | Ota et al. | 2/69 |
| 2005/0086721 | A1 | * | 4/2005 | Lambertz | 2/69 |
| 2005/0193461 | A1 | * | 9/2005 | Caillibotte et al. | 2/69 |
| 2005/0239370 | A1 | * | 10/2005 | Oyama et al. | 450/99 |
| 2006/0009726 | A1 | * | 1/2006 | Clement | 602/61 |
| 2006/0074365 | A1 | * | 4/2006 | Brown | 602/24 |
| 2008/0194181 | A1 | * | 8/2008 | Sudo et al. | 450/123 |

FOREIGN PATENT DOCUMENTS

| | | | | |
|---|---|---|---|---|
| EP | 1 016 351 | | * | 5/2000 |
| JP | 07-003505 | A | | 1/1995 |
| JP | 09-119003 | A | | 5/1997 |
| JP | 9-149959 | A | | 6/1997 |
| JP | 09-241906 | A | | 9/1997 |
| JP | 10-211225 | A | | 8/1998 |
| JP | 10251904 | A | * | 9/1998 |
| JP | 10-280209 | A | | 10/1998 |
| JP | 2896647 | B2 | | 3/1999 |
| JP | 3062222 | U | | 9/1999 |
| JP | 2606340 | U | | 10/2000 |
| JP | 2001-192903 | A | | 7/2001 |
| JP | 2002-212814 | A | | 7/2002 |
| JP | 2002-235207 | A | | 8/2002 |
| JP | 2003-010217 | A | | 1/2003 |
| WO | WO-01/80675 | A1 | | 11/2001 |

* cited by examiner

CROTCH-POSSESSING GARMENT

CROSS-REFERENCE TO PRIOR APPLICATION

This is a U.S. National Phase application under 35 U.S.C. §371 of International Patent Application No. PCT/JP2004/006184 filed Apr. 28, 2004, and claims the benefit of Japanese Patent Application No. 2003-126492 filed May 1, 2003, both of which are incorporated by reference herein. The International Application was published in Japanese on Nov. 11, 2004 as WO 2004/096105 A1 under PCT Article 21(2).

TECHNICAL FIELD

The present invention relates to a crotch-possessing garment and, more particularly, to a crotch-possessing garment applied to correct leg lines, such as a long girdle, a panty stocking, tights, a men's and women's spats type swimming wear, and a men's and women's sportswear.

BACKGROUND ART

In crotch-possessing garments such as, for example, a long girdle, a panty stocking, tights, a men's and women's spats type swimming wear, and men's and women's sportswear, fabrics of different elastic properties are disposed to the sections corresponding to the respective regions of the body. Each of the crotch-possessing garments is thus provided with a function commensurate with the concept thereof. As such a crotch-possessing garment, Patent Document No. 1 (Japanese Registered Utility Model Application No. 3062222), for example, discloses a girdle. The girdle uses a strong clothing fabric on the rear side of a thigh, which extends from the inside of a crotch to an outside flank region, thereby pressing the rear side of the thigh to make it beautiful and enhancing a hip-lifting effect. Further, Patent document No. 2 (Japanese Patent Application Laid-Open No. HEI9-119003) discloses a panty stocking which achieves a swell control effect at an abdomen and hip-lifting effect. An upper section of a thigh of the panty stocking is provided with a garter belt surrounding the thigh. Furthermore, Patent Document No. 3 (Japanese Patent Application Laid-Open No. 10-211225) discloses a stocking for correcting varus and internal rotation of knee, which achieves treatment, prevention, and gait improvement for osteoarthritis of knee joint by winding up a stretchable belt in a region from a leg to a lower abdomen in a direction in which the knee is twisted outward. Furthermore, Patent Document No. 4 (Japanese Patent Application Laid-Open No. 9-149959) discloses sport spats, which prevent fatigue of a muscle and produce a smooth movement by supporting muscles with a tightening belt provided on an upper knee region and achieving a taping effect. Patent Document No. 5 (Japanese Patent Application Laid-Open No. 9-241906) discloses a sportswear, which prevents sports disorders by forming a stretch control support line part, which is formed in the longitudinal direction of the wear, in a direction in which motions of muscles and joints are regulated and a taping effect can occur.

DISCLOSURE OF THE INVENTION

However, the aforementioned crotch-possessing garments which are disclosed in the above-described Patent Documents have the main concepts of enhancing a hip-lifting effect, treatment or prevention of the osteoarthritis of knee joint, and improving the ability to exercise, and have no concept of turning a thigh inward in order to correct too much opening of the knees such as, so called, bow-legs. Therefore, the conventional crotch-possessing garments are unable to facilitate to turn knees of a wearer inward and correct leg lines where the knees open outward.

An object of the present invention is, therefore, to provide a crotch-possessing garment for facilitating to correct leg lines in order to turn knees of a wearer inward.

A crotch-possessing garment of the present invention comprises: a main body part which covers at least a region from a lumbar region to an upper region of a thigh; and a stretchable support line part which covers, in the form of a belt, a region in which great adductor muscle of the thigh is located, wherein the support line part has a lower end located at a position corresponding to a section outer than at least a front line extending in a longitudinal direction of a thigh bone, and the upper end located at a position which is a rear side of the thigh and corresponds to a section outer than at least an inner end of ramp-cleft, the support line part is arranged from the lower end to the upper end through a section corresponding to the front line in a spiral, and the tightening force of the support line part is stronger than the tightening force of the main body part.

When the crotch-possessing garment according to the present invention is worn, the region in which great adductor muscle is located is covered in the form of a belt, and the support line part having strong tightening force is stretched in accordance with a movement of the wearer. Particularly, a large tightening force is generated in a section corresponding to the inside of the thigh where the skin is stretched significantly in accordance with the movement of the wearer. By this tightening force being generated, a force for turning the thigh-bone inward acts on the inner side of the thigh where great adductor muscle is located, with the hip joint as a supporting point. Accordingly, a movement of great adductor muscle can be supported, whereby the knee of the wearer can be turned inward comfortably, and eventually the leg line can be corrected.

In the crotch-possessing garment according to the present invention, it is preferred that the lower end of the support line part is located at a position outer than at least a central section in the front line extending in the longitudinal direction of the thigh bone. In this manner, the support line part abuts with the position corresponding to the central section in the front line extending in the longitudinal direction of the thigh bone, thus the adductor muscles are securely supported, and the knee of the wearer can be turned inward easily.

In the crotch part-possessing garment according to the present invention, it is preferred that the lower end of the support line part is located on a flank side central line extending in the longitudinal direction of the thigh, or on a connecting line on which the front part and rear part of the main body part are connected. Further, it is preferred that the upper end of the support line part is located on an extension of a flank side central line extending in the longitudinal direction of the thigh, or on the connecting line on which the front part and rear part of the main body part are connected. In this manner, the support line part acts in conjunction with regions which move largely, such as the buttocks and the rear side of the thigh, and receives tension from these regions, thus the tightening force thereof is enhanced. Accordingly, the effect of supporting the great adductor muscle is enhanced.

It is preferred that the crotch-possessing garment according to the present invention further comprises: a lower end side filler cloth which overlaps with or continues into a lower end section of the support line part; and an upper end side filler cloth which overlaps with or continues into an upper end section of the support line part, wherein the lower end side filler cloth and the upper end side filler cloth are non-stretchable or hard to stretch. In this manner, the lower end side filler cloth and the upper end side filler cloth which are non-stretchable or hard to stretch are fixed firmly to the body of the wearer, whereby the support line part is stretched along the great adductor muscle in a state in which the support line part is firmly attached to the thigh. Accordingly, the effect of supporting the great adductor muscle is enhanced.

In the crotch-possessing garment according to the present invention, it is preferred that the stress ratio of the tightening force of the main body part to the support line part is in a range of 1:1.5 through 3.5. Accordingly, movement of the great adductor muscle is supported effectively.

BEST MODES FOR CARRYING OUT THE INVENTION

Before a description of an embodiment, a beautiful leg line (shapely legs), which is the background of the present invention, is now described with reference to FIG. 1A, FIG. 1B, FIG. 2A, FIG. 2B, and FIG. 3. It should be noted that the terms indicating the directions, which are used in the present description, are defined as follows. Namely, a state in which the body stands up straight is taken as reference, a direction in which a region near the head among the target regions such as the thigh and the like is defined as "upper," and the opposite direction thereof is defined as "lower". Further, assuming a central axis passing in the longitudinal direction through the body standing straight, the direction from the central axis to the back side is defined as "rear," the opposite direction thereof is defined as "front." Furthermore, the direction in which the distance from the central axis line increases is defined as "outside," and the direction in which the distance from the central axis line decreases is defined as "inside."

Figure 1A:
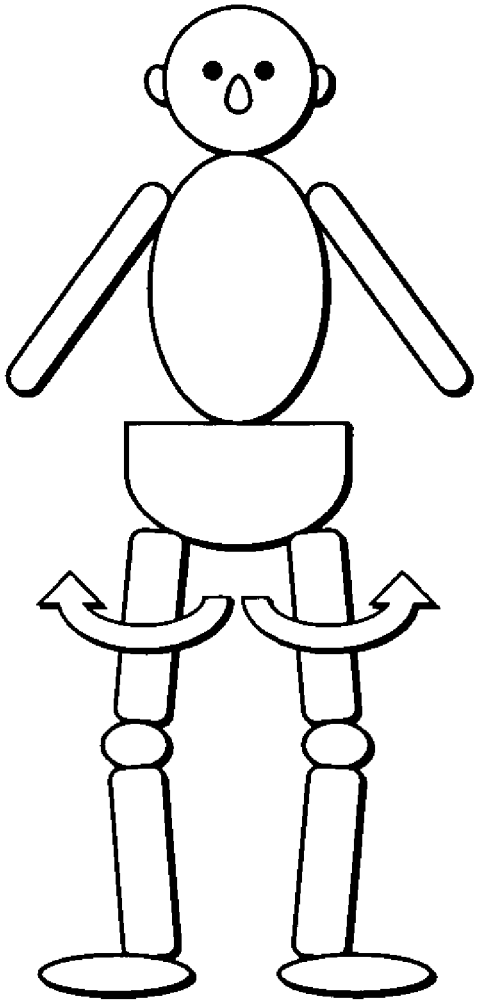
FIG. 1A is a front view showing a bone structure and muscles of the thigh, and shows a posture when both knees are opened outward.
Figure 1B:
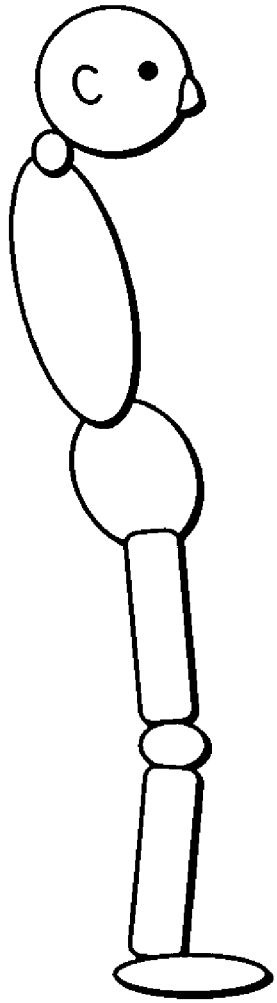
FIG. 1B is a right side view showing the bone structure and muscles of the thigh, and shows a posture when both knees are opened outward.
Figure 2A:
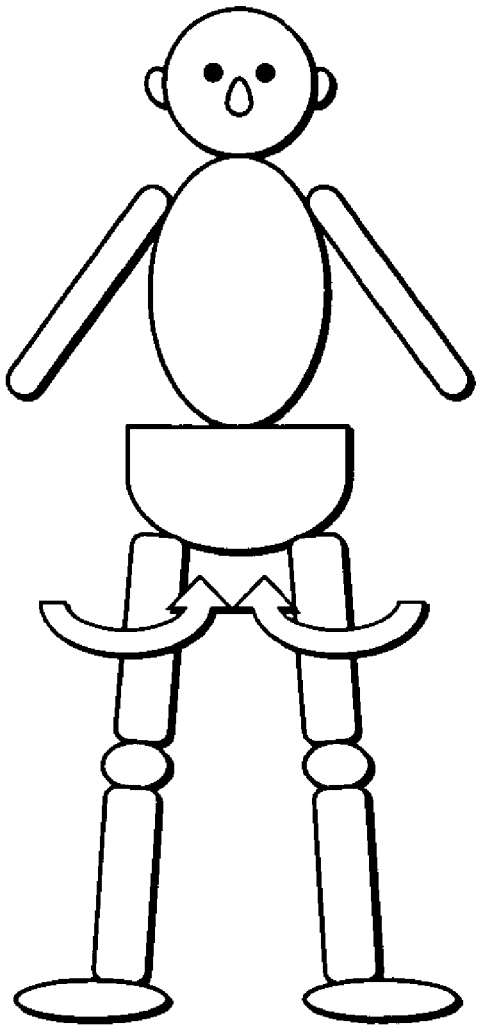
FIG. 2A is a front view of a posture when the thigh is twisted inward.
Figure 2B:
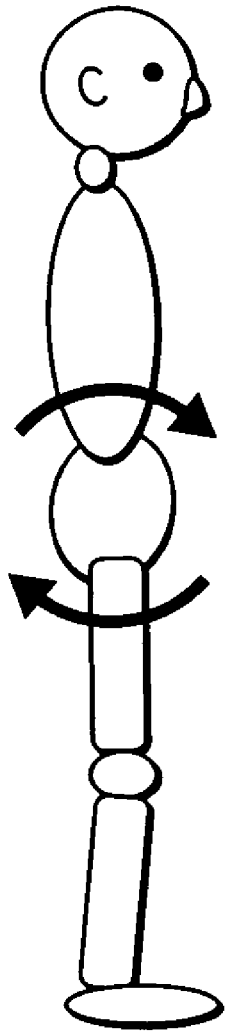
FIG. 2B is a right side view of a posture when the thigh is twisted inward.
Figure 3:
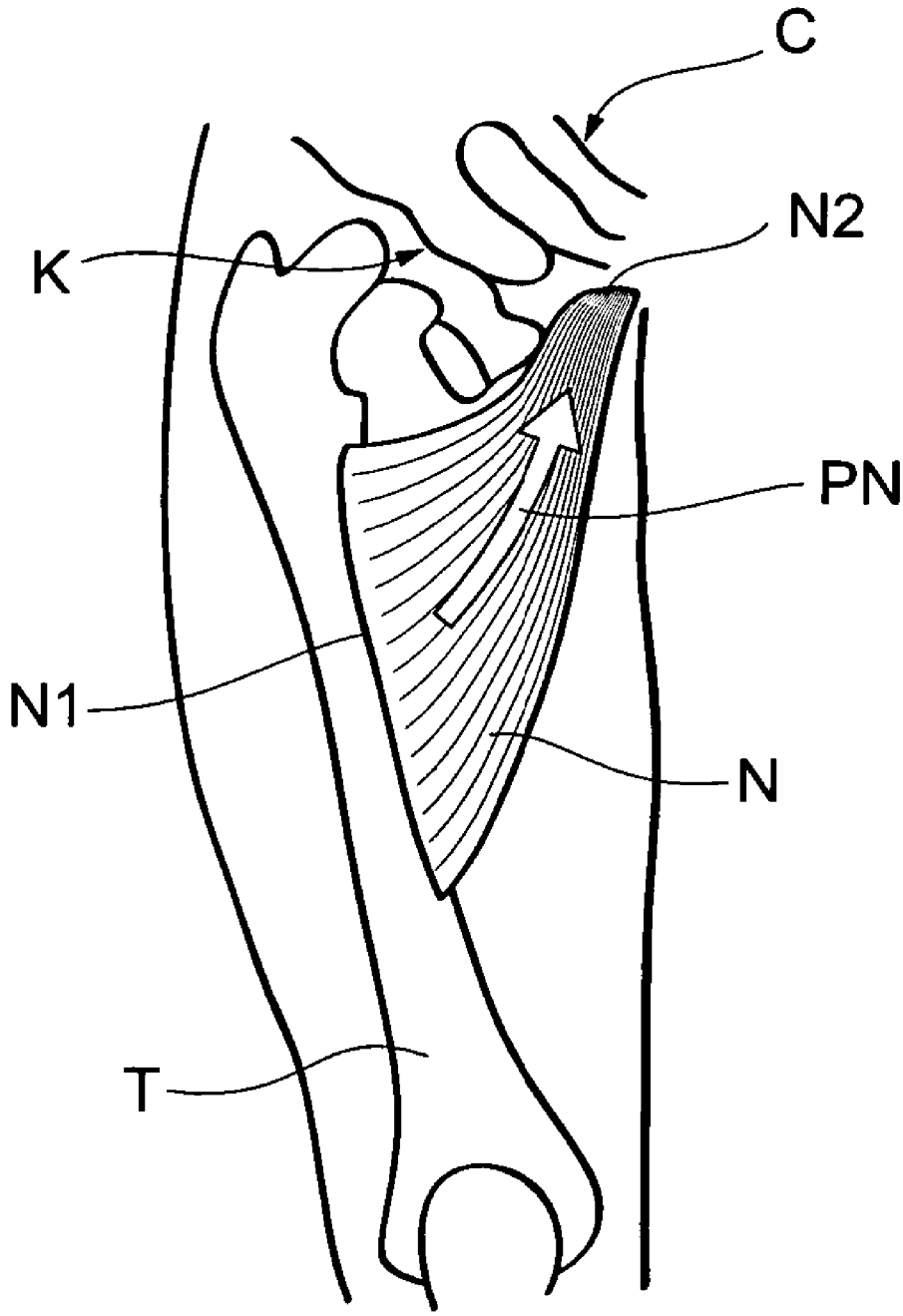
FIG. 3 is a front view schematically showing a structure of a bone and muscle of the right thigh.

FIG. 1A is a front view showing a bone structure and muscles of the thigh, and shows a posture when both knees are opened outward. FIG. 1B is a right side view showing the bone structure and muscles of the thigh, and shows a posture when both knees are opened outward. FIG. 2A is a front view of a posture when the thigh is twisted inward. FIG. 2B is a right side view of a posture when the thigh is twisted inward. FIG. 3 is a front view schematically showing a structure of a bone and muscle of the right thigh.

The present applicant has pursued means for realizing the shapely legs in view of the fact that one of the parts in a body that women wish to improve most is "legs," and has focused on correcting both knees being separated when standing up, lining up the legs, i.e., correcting bow-legs. As a result, first of all, as shown in FIG. 1A, it has been proven that, when both knees are opened outward, not only that the legs become bow-legs, but also the pelvis tends to incline backward, and the leg line and the entire posture become poor as shown in FIG. 1B. When force is applied from the state shown in FIG. 1A in a direction of an arrow shown in FIG. 2A, or force for turning the thigh inward is applied to the thigh, it has been proven that the bow-legs are corrected and, as shown in FIG. 2B, the backward inclination of the pelvis is corrected, and further the shapely legs and shapely posture (beautiful posture) can be realized. Here, the force applied to the thigh is described with reference to FIG. 3. As shown in FIG. 3, great adductor muscle N is present on the inner side of the thigh bone T of the thigh and the bottom section of the hip joint K and pubic bone C. This great adductor muscle N is muscle that has the action of turning the thigh inward or bringing the thigh close to the central axis of the body. Therefore, by applying force PN to the great adductor muscle N in a direction from a thigh bone side end section N1 of the great adductor muscle N to a pubic bone side end section N2 of the great adductor muscle N (direction of an arrow shown in FIG. 3), the space between the knees are narrowed, the bow-legs are corrected, and the backward inclination of the pelvis can be corrected.

The present applicant has completed the present invention through the knowledge that a state in which the great adductor muscle acts may be maintained and a beautiful leg line and beautiful posture may be easily maintained by adopting a structure in which movement of the great adductor muscle is supported.

Hereinafter, embodiments of the present invention are described according to the drawings. It should be noted that the same reference symbols are used to indicate the same or like components, thus the overlapping explanations are omitted.

Figure 4:
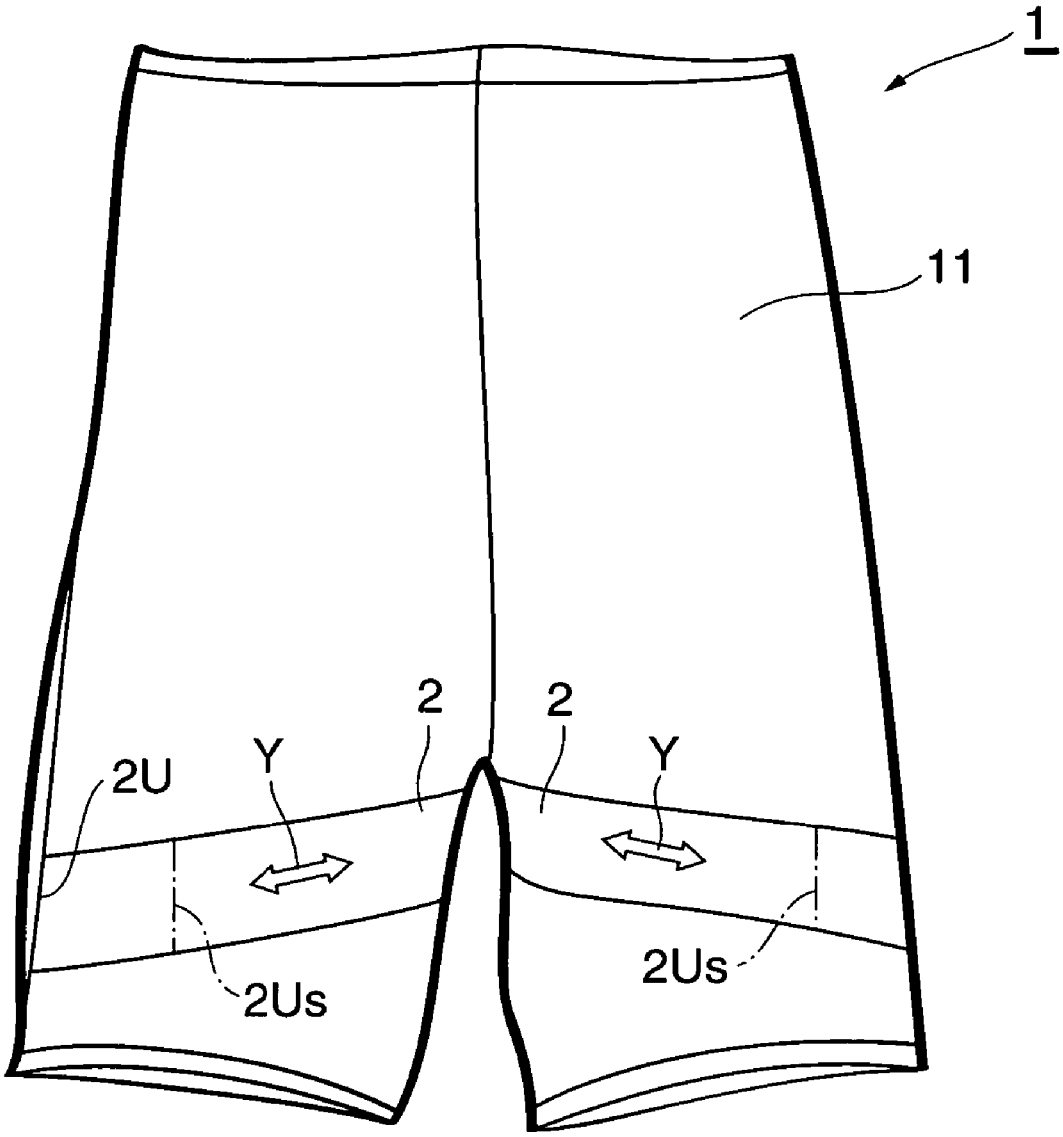
FIG. 4 is a front plan view of a long girdle of an embodiment.
Figure 5:
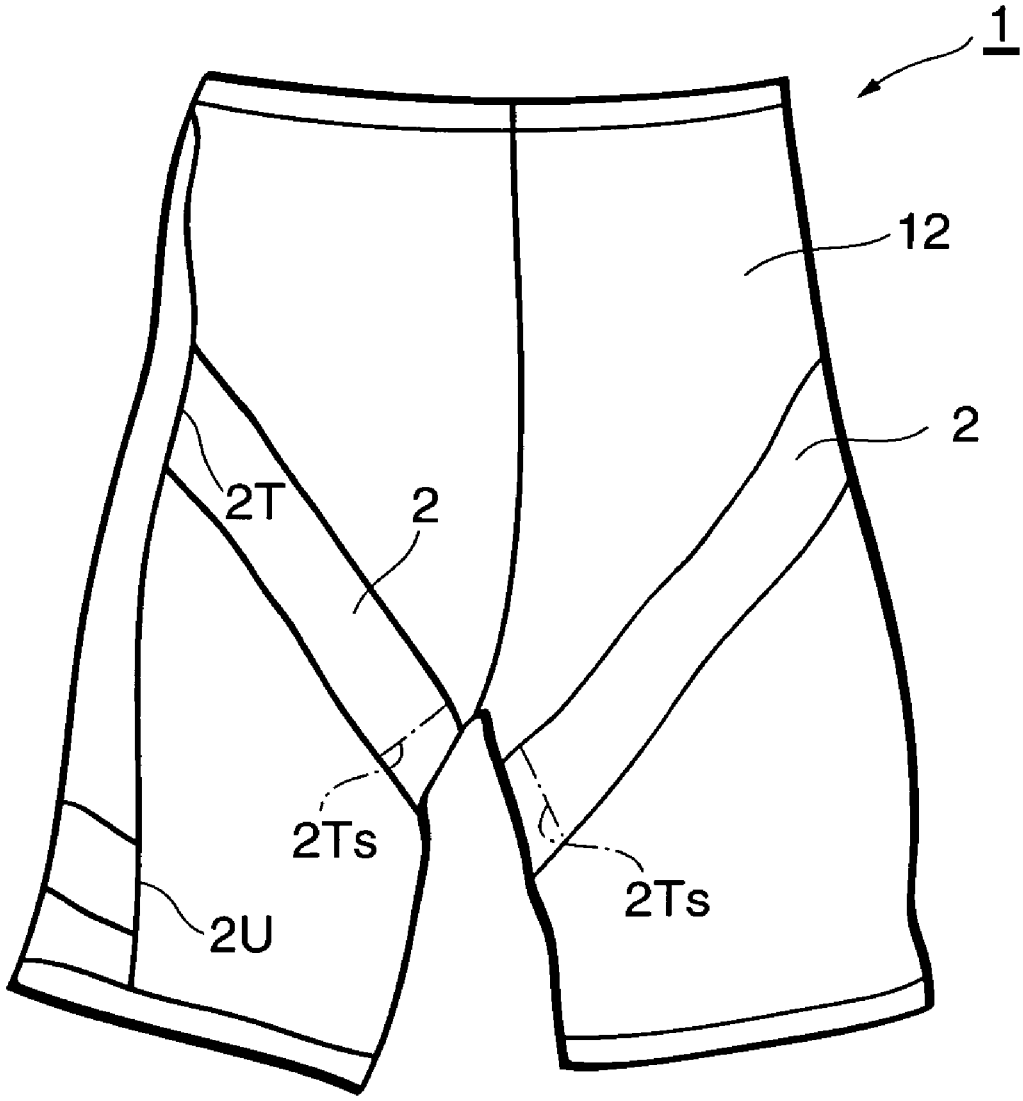
FIG. 5 is a back plan view of the long girdle of the embodiment.
Figure 6:
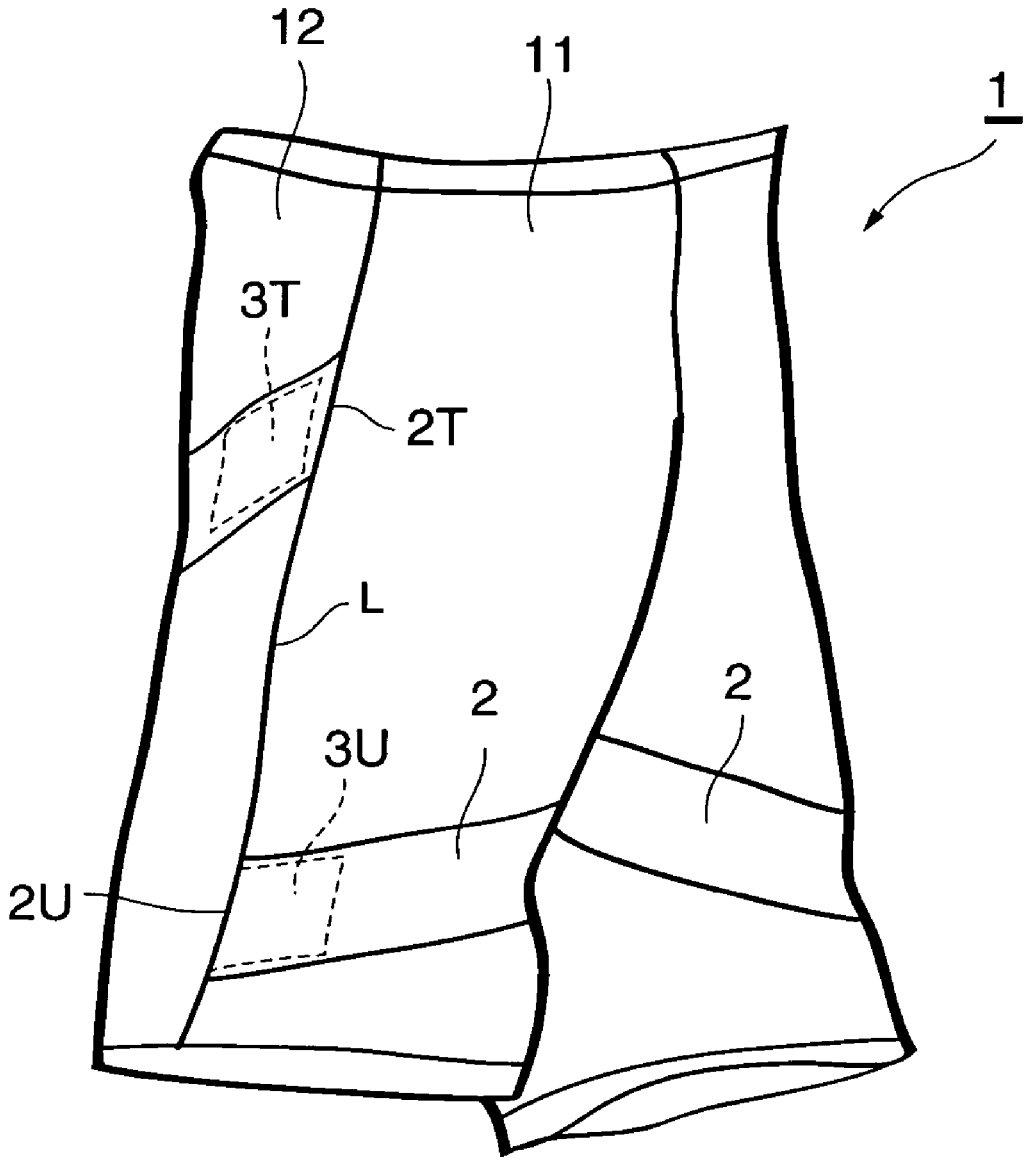
FIG. 6 is a front view in which the long girdle of the embodiment is obliquely viewed from the right side.

A long girdle (crotch part-possessing garment) of the present embodiment is described with reference to FIG. 4, FIG. 5, and FIG. 6. FIG. 4 is a front plan view of a long girdle of an embodiment, FIG. 5 is a back plan view of the long girdle of the embodiment, and FIG. 6 is a front view in which the long girdle of the embodiment is obliquely viewed from the right side.

As shown in the figures, the long type girdle has a main body part 1 which covers a region from a lumbar to an upper region of a thigh, and a band-like support line part 2 which is stitched on a section of the main body part 1. The main body part 1 has a front main body part 11 which covers a region from the front side of the lumbar to the front side of the thigh, and a rear main body part 12 which covers a region from the rear side of the lumbar to the buttocks and the rear side of the thigh.

The support line part 2 has a lower end 2U at a part of a lower side of a connecting line L at which the front main body part 11 and rear main body part 12 are connected, and an upper end 2T at a part of an upper side of the connecting line L at which the front main body part 11 and rear main body part 12 are connected. The support line part 2 is arranged from the lower end 2U to the upper end 2T through the front side of the thigh and the section which is located at the rear side of the thigh and the lower section of the rump-cleft, in a spiral. Specifically, the support line part 2 arranged from the above-mentioned lower end 2U to the upper end 2T in a spiral so as to cover, in the form of a band, a region where the great adductor muscle of the thigh is located. It should be noted that the support line part 2 does not necessarily have a uniform width in the entire section from the lower end 2U to the upper end 2T. The support line part 2 may be formed so as to support the great adductor muscle.

The main body part 1 and the support line part 2 are configured with an stretchable material. Examples of the stretchable material include a power net, satin net, tricot net, two-way tricot, and two-way raschel. Although the main body part 1 and support line part 2 are configured with the similar material described above, the present invention is characterized in that the support line part 2 is stronger than the main body part 1 in terms of the tightening force of fabrics.

In order to measure the tightening force of the main body part 1 and the tightening force of the great adductor muscle support part 2, the present applicant has performed a stretch recovery test (at the time of 30% stretch). In this test, a test piece of 2.5 cm in width * 16.0 cm in height, of which the material radial direction (wale direction) was set in the longitudinal direction of the test piece, was used. The longitudinal direction of the test piece was defined as the vertical direction, and the test piece which was clipped in the upper section of 2.5 cm and the lower section of 3.5 cm, was fixed to a constant-rate-of-extension tensile machine (Shimadzu Corporation, "Auto-graph," AG-1KND). After stretching the test piece to 80% at a rate of 30+/−2 cm/min, the stress applied to the test piece was removed, the stress applied to the test piece at the time of an extension percentage of 30% when the test piece returned to its original length was recorded, and the average value of the stresses recorded for the two test pieces was used as the tightening force.

As a result, it has been proved that the stress ratio of the tightening force of the main body part 1 section to the support line part 2 is preferably in a range of 1:1.5 through 3.5, and that the stress ratio is more preferably 1:2.5. The support line part 2 is sewed so that the expansion and contraction direction (grain direction) in which the tightening force can be exerted most, becomes the longitudinal direction of the support line part 2. Further, the support line part 2 is preferably stitched in a fixed, inseparable manner on the main body part 1 so that the longitudinal direction of the support line 2 necessarily coincides with the direction of the movement of the great adductor muscle (arrow direction Y shown in FIG. 4). Accordingly, the force generated by expansion and contraction of the support line part 2 supports the movement of the great adductor muscle effectively.

The long girdle according to the present embodiment has an effect described hereinbelow by comprising such support line part 2. When the long girdle is worn, the support line part 2 having strong tightening force stretches, and expands and contracts in accordance with movement of the wearer. Here, when imagining a central axis passing through the inner side of the thigh in which the great adductor muscle is located, in the longitudinal direction, that is, through the body standing up straight, the region in the vicinity of the central axis in the thigh is a region where the skin is stretched significantly in accordance with the movement of the hip joint, such as walking or bending. Therefore, the support line part 2 and the main body part 1 corresponding to this region, that is, the support line part 2 and the main body part 1 covering this region easily stretch in particular. Accordingly, the support line part 2 corresponding to the inner side of the thigh, that is, the support line part 2 covering the inner side of the thigh receives tension also from the main body part 1 corresponding to the inner side of the thigh, that is, the main body part 1 covering the inner side of the thigh, and the tightening force of the support line part 2 is further reinforced. Due to the generation of the tightening force, large force, such as the one which pulls back by a spring, acts at the inner side of the thigh where the great adductor muscle is located. Specifically, force for turning the thigh bones inward acts, with the hip joint as a supporting point. Such force acting in this manner supports the movement of the great adductor muscle, whereby the knees are turned inward easily. Accordingly, the bow-legs are corrected, and shapely legs and shapely posture can be realized.

Moreover, the support line part 2 is disposed so as to pass through the rump-cleft which is located between a buttock and the rear side of the thigh. The buttock and the rear side of the thigh are the regions where the skin is stretched significantly in accordance with the movement of the hip joint, such as walking or bending. Therefore, the main body part 1 corresponding to these regions is stretched significantly, whereby large tension from these regions acts on the support line part 2, thus the elongation of the support line part 2 is further increased. Namely, the support line part 2 receives large tension by working with a region moving significantly, such as a buttock and a rear side of the thigh, and the tightening force of the support line part 2 is further reinforced. Such a phenomena is not realized by taping in which a tape is fixed on a body, thus the effect realized in the present invention has a marked effect in comparison with the taping technique.

Further, the support line part 2 is disposed so as to pass through the rump-cleft which moves less, thus a situation where movement of the wearer is inhibited by the support line part 2 with high tightening force can be reduced.

Next, as shown in FIG. 6, a lower end side filler cloth 3U which is non-stretchable or hard to stretch is stitched on the back side of the lower end section of the support line part 2, and an upper end side filler cloth 3T which is non-stretchable or hard to stretch is stitched on the back side of the upper end section of the support line part 2. The lower end side filer cloth 3U and the upper end side filler cloth 3T are made of a material which is non-stretchable or hard to stretch, and is taut and firm. Examples of the material of the lower end side filler cloth 3U and the upper end side filler cloth 3T include double raschel, one-way material, marquisette, and tricot. By using such a fabric with little stretch, the lower end side filler cloth 3U and the upper end side filler cloth 3T are hardly stretched even when the long girdle is worn. Therefore, when the girdle is worn, the lower end section and the upper end section of the support line part 2 are inseparably attached to the main body part 1 and can be prevented from being misaligned. It should be noted that the lower end side filler cloth 3U or the upper end side filler cloth 3T are not necessarily stitched on the back side of the lower end section or of the upper end section of the support line part 2 in an overlapping manner, and, for example, may be stitched on the surface side of the lower end section or of the upper end section of the support line part 2. Moreover, for example, the lower end side filler cloth 3U or the upper end side filer cloth 3T may be stitched so as to be successively disposed to a lower end edge or upper end edge of the support line part 2. Namely, if the lower end section of the support line part 2 and the lower end side filler cloth 3U are stitched together so as to overlap or continue into each other, and if the upper end section of the support line part 2 and the upper end side filler cloth 3T are stitched together so as to overlap or continue into each other and be inseparable thereby from the main body part 1, the lower end section or upper end section of the support line part 2 can be prevented from being misaligned when the long girdle is worn. Alternatively, the support line part 2 may not necessarily stitched on the lower end side filler cloth 3U and the upper end side filler cloth 3T, thus, for example, change by knitting, a quilt, filler cloth, or connecting piece may be used.

Furthermore, when the girdle is worn, the lower end side filler cloth 3U and the upper end side filler cloth 3T are firmly fixed to the body, whereby the support line part 2 expands and contracts along the great adductor muscle in the state where the support line part 2 is firmly attached to the thigh (along the arrow direction Y shown in FIG. 4). Therefore, force for turning the thigh inward acts effectively on the support line part 2 attached firmly to the thigh section, with the firmly fixed lower end side filler cloth 3U and upper end side filler cloth 3T as the supporting points.

In the above-described embodiment, in the support line part 2, the lower end 2U is disposed on a part of the lower side of the connecting line L at which the front main body part 11 and rear main body part 12 are connected, and the upper end 2T is disposed on a part of the upper side of the connecting line L at which the front main body part 11 and rear main body part 12 are connected. However, since there is a crotch-possessing garment which does not have a connecting line, or a crotch-possessing garment having a connecting line at a different position, the lower end 2U and the upper end 2T are not necessarily located on the connecting line. Therefore, for example, the lower end of the support line part may be located on a flank side central line extending in the longitudinal direction of the thigh, and the upper end of the support line part may be located on an extension of a flank side central line extending in the longitudinal direction of the thigh. In other words, when imagining a central axis passing in the longitudinal direction through the body standing up straight, the flank side central line is, in a region of the thigh far from the central axis, a line which passes though the center of this region in the longitudinal direction, and the lower end of the support line part may be provided along the flank side central line when the girdle is worn. Further, when the girdle is worn, the upper end of the support line part may be provided along the flank side central line or an extension thereof in a section upper than the lower end of the support line part.

The lower end and upper end of the support line part 2 are not necessarily located on the flank side central line extending in the longitudinal direction of the thigh, thus the lower end may be located at a position 2Us corresponding to a section outer than at least a front central line extending in the longitudinal direction of the thigh (see FIG. 4), and the upper end may be located at a position 2Ts (see FIG. 5) which is a rear side of the thigh and corresponds to a section outer than the inner end of the rump-cleft. In other words, the front central line (front line) is a line passing in a longitudinal direction through the surface of the thigh located at front of the thigh bone, and the lower end of the support line part 2 may be provided, when the girdle is worn, along a section outer than the front central line, that is, when imagining a central axis passing in the longitudinal direction through the body standing up straight, a section far from the front central line with respect to the central axis.

Hereinafter, the position 2Us of the lower end of the support line part 2 will be described in detail. The position 2Us is a position corresponding to the section outer than the vicinity of the center (central section) in the longitudinal direction of the thigh bone. In other words, when assuming that there is a central axis passing in the longitudinal direction through the body standing up straight, the position 2Us is a position in the surface of the thigh far from the vicinity of the center in the longitudinal direction of the thigh bone with respect to the central axis. Specifically, the position 2Us may be located on a limit line where the support line part 2 can support the vicinity of the center in the longitudinal direction of the thigh bone. The vicinity of the center in the longitudinal direction of the thigh bone is a section in which the adductor muscles are thickest and concentrated most, thus, by supporting this section by means of the support line part 2, the adductor muscles can be supported securely and the knees of the wearer can be turned inward easily.

Furthermore, in the above-described embodiment, the support line part 2 is preferably stitched on the main body part 1, so that it inseparable from the main body part 1. Alternatively, the support line part may not be stitched to the main body part, thus, for example, enabling a power change by knitting, a quilt, filler cloth, or a connecting piece forming the support line part 2 on the main body part 1.

Moreover, in the above-described embodiment, the long girdle is described as a typical example of the crotch-possessing garment. However, the present invention can be applied to a garment other than the long girdle. For example, the present invention can be applied to a crotch-possessing garment such as a panty stocking, tights, a men's and women's spats type swimming wear, and a men's and women's sportswear.

Three monitors performed trial fitting of the long girdle which was a trial product, and then made ten steps. After that, the spaces between the knees (opening of the knees) of the monitors were measured when the monitors standing up naturally. According to this measurement, the spaces between the knees of all monitors were narrowed in comparison with the spaces between same in a nude state. To describe this in concrete terms by using a measured value, the average value of the measured value of the monitors was 15.8 cm when the trial product was worn, whereas the average value was 17.3 cm in the nude state. Accordingly, it has been confirmed that the space between knees is narrowed by wearing the long girdle of the trial product. Moreover, regarding easiness of closing knees when sitting with wearing the long girdle of the trial product, two of the three responded by saying "easier to close our knees than in the nude state." By taking into account these results, it is proved that the long girdle of the present embodiment has an effect of correcting the leg line and posture.

In conclusion, the present invention has a basic configuration in which the support line part 2 of the crotch-possessing garment as typified by a long girdle and the like is firmly attached to the thigh to support movement of the great adductor muscle. Accordingly, the knees can be turned inward easily, a situation in which the knees are opened outward naturally can be prevented, and the legs can be made look beautifully. Therefore, with such a configuration, not only the above-described embodiment or modified example, but also various aspects become possible.

INDUSTRIAL APPLICABILITY

According to the crotch-possessing garment of the present invention, beneficial effects are expected such that movement of the great adductor muscle can be supported, whereby the knees of a wearer can be turned inward easily, and eventually the leg line can be made look beautifully.

The invention claimed is:

1. A crotch-possessing garment, comprising:

a main stretchable body part for covering from at least a lumbar region to an upper thigh region of a wearer, the main stretchable body part having:

a front main body side, a rear main body side, lateralmost edges defining left and right flank side central lines extending parallel to a longitudinal centerline of the main stretchable body part, and left and right leg parts extending inwardly from the left and right flank side central lines, respectively, toward inner edges defining an inner leg potion of the main stretchable body part, the inner leg portion terminating at a crotch region along the longitudinal centerline of the main stretchable body part; and a stretchable support line part for covering, in the form of a belt, a region in which the great adductor muscle of a thigh of the wearer of the crotch-possessing garment is located, wherein:

the support line part has a lower end and an upper end each corresponding to predetermined positions, the lower end terminating at a first predetermined position on one of the leg parts that is laterally and outwardly displaced from the inner leg portion, and the upper end terminating above the lower end at a second predetermined position on the rear main body side and above the leg parts and crotch region that is laterally and outwardly displaced from the longitudinal centerline, the support line part is inseparably attached to the main stretchable body part, the support line part extends continuously upwardly from the first predetermined position at the lower end to cover a front side of the one leg part, to cross over the inner leg portion in proximity to the crotch portion, to extend onto a rear side of the one leg part and then terminate at the second predetermined position at the upper end, and the support line part forms a spiral around the one leg part to support movement of a great adductor muscle of the wearer.

2. The crotch-possessing garment according to claim 1, wherein the lower end of the support line part laterally extends from at least a central portion of the one leg part on the front main body side.

3. The crotch-possessing garment according to claim 1, wherein the lower end of the support line part terminates at one of the flank side central lines.

4. The crotch-possessing garment according to claim 1, wherein the upper end of the support line part terminates at one of the flank side central lines.

5. The crotch-possessing garment according to claim 1, further comprising:

a lower end side filler cloth which overlaps with or continues into a lower end section of the support line part; and an upper end side filler cloth which overlaps with or continues into an upper end section of the support line part, wherein the lower end side filler cloth and the upper end side filler cloth are non-stretchable or hard to stretch.

6. The crotch-possessing garment according to claim 1, wherein the stress ratio of the tightening force of the main body part to the support line part is in a range of 1:1.5 through 3.5.

7. The crotch-processing garment according to claim 1, wherein a portion of the one support line part crossing over the inner leg portion covers an upper portion of the inner leg portion.

8. The crotch-processing garment according to claim 1, further comprising:

a second stretchable support line part for covering, in the form of a belt, a region in which the great adductor muscle of a second thigh of the wearer of the crotch-possessing garment is located, wherein:

the second support line part has a lower end and an upper end each corresponding to predetermined positions, the lower end terminating at a third predetermined position on the other one of the leg parts that is laterally and outwardly displaced from the inner leg portion, and the upper end terminating above the lower end a fourth predetermined position on the rear main body side and above the leg parts and the crotch region that is laterally and outwardly displaced from the longitudinal centerline, the second support line part is inseparably attached to the main stretchable body part, the second support line part extends continuously upwardly from the third predetermined position at the lower end to cover a front side of the other leg part, to cross over the inner leg portion in proximity to the crotch portion, to extend onto a rear side of the other leg part and then terminate at the fourth predetermined position at the upper end, and the second support line part forms another spiral around the other leg part to support movement of another great adductor muscle of the wearer.

* * * * *